United States Patent [19]

Cabourne

[11] Patent Number: 5,004,438

[45] Date of Patent: Apr. 2, 1991

[54] FLEXIBLE PIN TYPE CONTACT

[75] Inventor: Michael K. Cabourne, Fullerton, Calif.

[73] Assignee: Precision Interconnect Corporation, Portland, Oreg.

[21] Appl. No.: 548,291

[22] Filed: Jul. 3, 1990

[51] Int. Cl.[5] ..... H01R 13/05

[52] U.S. Cl. ..... 439/825

[58] Field of Search ..... 439/825, 826, 827, 816, 439/851

[56] References Cited

U.S. PATENT DOCUMENTS

| | | | |
|---|---|---|---|
| D. 263,219 | 3/1982 | Viets | D13/24 |
| 1,376,735 | 5/1921 | Stalhane et al. | 439/825 |
| 3,538,491 | 11/1970 | Longenecker et al. | 439/851 |
| 3,663,930 | 5/1972 | Henschen et al. | 439/825 |
| 4,169,654 | 10/1979 | Plyler et al. | 439/825 |
| 4,437,726 | 3/1984 | Lambert | 439/825 |
| 4,596,440 | 6/1986 | Quam | 439/827 |
| 4,820,207 | 4/1989 | Zic | 439/825 |

*Primary Examiner*—Joseph H. McGlynn
*Assistant Examiner*—Hien D. Vu
*Attorney, Agent, or Firm*—Chernoff, Vilhauer, McClung & Stenzel

[57] ABSTRACT

A flexible electrical pin type contact including a plurality of elongate arm members, the opposed ends of each arm member being folded back toward each other so that intermediate sections on each arm member are flexibly outwardly bent from each other for wiping engagement with the inner surface of a mating socket. The intermediate section on each arm member divides the arm member into forward and rearward arm portions that taper toward each other to form a narrowed region in the intermediate section. The flared edge portions of each forward or rearward arm portion are folded back toward each other so that the radius of curvature established in each arm portion is smaller than the radius of curvature of the inner surface of the tubular socket. This configuration keeps burrs formed along the edges of the arm members away from the inner surface of the socket while also perserving a high degree of arm flexibililty to allow engagement of the pin contact with different sockets that vary somewhat in diameter.

4 Claims, 2 Drawing Sheets

FLEXIBLE PIN TYPE CONTACT

BACKGROUND OF THE INVENTION

This invention relates to the field of electrical connectors and more particularly to flexible pin type contacts of the type formed in one piece from thin metal stock for detachable wiping-type engagement with the inside surface of tubular sockets.

To make flexible pin type contacts the practice has been to stamp a number of blanks from a single piece of flat metal stock and then to form each blank into the shape of an individual pin contact. To wipingly engage the inside surface of the tubular socket, each formed contact includes a plurality of forwardly extending elongate arm members. Often a protruding sleeve member is rearwardly formed on each contact so that the contact will come to rest, upon wiping engagement, against the protruding rim of the sleeve member.

During the stamping operation, frequently minute burrs are created along the corner edges of the blank and particularly along the corner edges of what will become the arm members. These burrs can interfere with continuous engagement between the arm members and the inside surface of the socket and thereby adversely affect the reliability of the resultant electrical connection.

One approach used to counteract the creation of these burrs has been to fold the edges of each arm back upon themselves. This folding is performed so that the radius of curvature of the arm in a transverse plane is less than the radius of curvature of the inner surface of the socket thereby elevating the burrs inwardly away from engagement with the inner surface of the socket. Reliable engagement with the inner surface of the socket is then made by the central crowned portion of each arm. Such an approach is described, for example, in Plyler et al., U.S. Pat. No. 4,169,654. The central crowned portion of each arm possesses some intrinsic flexibility which prevents excessive force concentration and wear along the pin and socket surfaces in actual contact. With the folding back of the edges of the arms, however, relative flexibility of the arms is severely limited so that the arms can be bent divergently outwardly from each other by only a small degree. It is desirable that a high degree of relative arm flexibility exists so that the arms of the pin will flex over a sufficient range to mate with different sockets that can vary in diameter.

A second approach used to counteract the creation of burrs has been to round off or coin the upper corner edges of each arm such as by pressure deformation or grinding. Pin contact arms having coined edges are shown, for example, in Lambert, U.S. Pat. No. 4,437,726. While this approach preserves the relative outward flexibility of the arms, these coined edges alone do little to prevent force concentration and the excessive wearing of the pin or socket surface materials.

A separate concern is the ability of the pin contact to adapt to longitudinal misalignment between the pin and mating socket. To address this concern, one practice has been to include a forward nose member on the contact where several elongate arms are provided extending from the rearward sleeve member to this forward nose member. This approach is shown in Henschen et al., U.S. Pat. No. 3,663,930 and Viets, U.S. Pat. No. Des. 263,219. If there is longitudinal misalignment between the pin and the mating socket before engagement, then the several arms permit repositioning or "floating" of the nose during engagement so that alignment will occur between the pin contact and the socket. Another advantage of using a forward nose member is that each arm can be outwardly bent beginning at each of its ends so that the fullest outward range of arm movement is achieved. A contrasting approach employing contacts having only a pair of arms is shown in Lambert, U.S. Pat. No. 4,437,726. Here each arm includes a reduced width portion rearwardly located on an unbent portion of the arm. The portion of the arm forward of this reduced width region can therefore be laterally twisted in a skewed direction from the portion of the arm rearward of this reduced width region to enable engagement of the forward arm portion with a socket in skewed misalignment with the pin contact.

Accordingly, it is an object of the present invention to provide a pin type contact that provides good electrical reliability upon engagement despite burr creation during stamping of the contact, that retains a high degree of arm flexibility both to reduce excessive surface wearing and to engage sockets that can vary in diameter, and that is relatively inexpensive to fabricate.

A further object of the present invention is to provide a pin type contact that is of one-piece construction and that adapts to misalignment between the contact pin and the socket.

SUMMARY OF THE INVENTION

To achieve the aforementioned objects, the present invention uses a pin contact having a narrowed section formed in about the center of each arm of the contact. Each arm is bent at this narrowed section so that upon nearing this section, each arm diverges flexibly outwardly from the longitudinal axis of the pin contact for wiping engagement with the socket. The portions of each arm that lie forward and rearward of the narrowed section have their edges folded back so that burrs created along these edges will not touch the inner surface of the socket during engagement and so that bending by the central crowned portion of each arm can reduce wear along the contacting surfaces. Despite the folding back of the edges of the forward and rearward arm portions, the arms retain a high degree of relative flexibility at the narrowed sections on each arm to permit mating with sockets of different diameter.

In a preferred embodiment of the present invention the narrowed section on each arm is located forwardly of the center of each arm as measured between the ends of each arm. This ensures close-fitting engagement between the contact and the socket even if a predominant portion of the contact arms cannot be inserted inside the socket.

In the preferred embodiment of the present invention, the contact also includes several arm members which, at their ends, support a fully integral nose member. This nose member is forwardly tapered so that the nose member will be guided into the socket even when the pin contact and the socket are off center before engagement. The flexibility of the several arm members permit reorientation of the nose member during engagement so that engagement will occur despite axial misalignment between the pin contact and the socket.

The foregoing and other objectives, features and advantages of the invention will be more readily understood upon consideration of the following detailed description of the invention, taken in conjunction with the accompanying drawings.

DETAILED DESCRIPTION OF THE INVENTION

Figure 1:
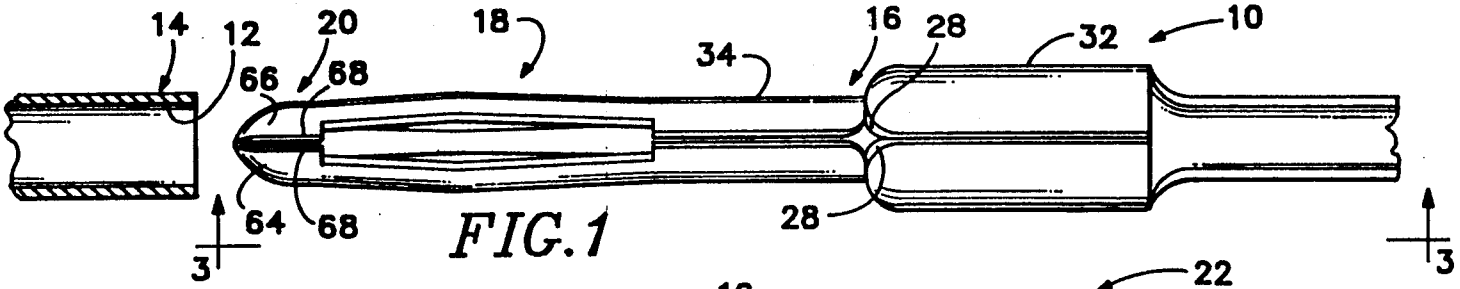
FIG. 1 is an elevational plan view of an exemplary embodiment of a flexible pin type contact in accordance with the present invention.

FIG. 1 shows an exemplary flexible pin type contact 10 constructed in accordance with the present invention for wiping type engagement with the inner surface 12 of a conventional female-type tubular socket 14. The exemplary pin type contact depicted comprises a rearwardly located sleeve member 16, a plurality of forwardly extending elongate arm members 18, and a nose member 20. The arm members 18 give the pin contact its flexibility. As configured, this flexible pin type contact may be miniaturized for use in a subminiature connector array.

Figure 2:
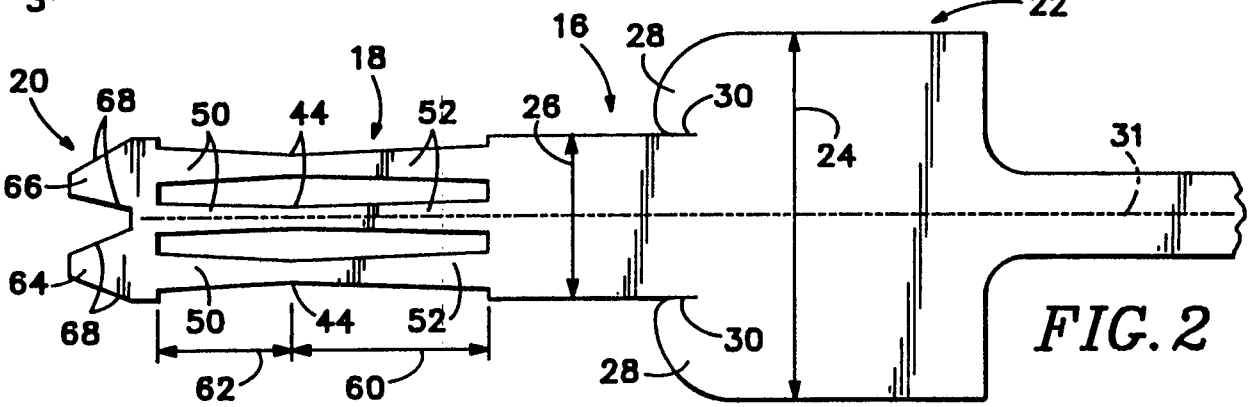
FIG. 2 is a plan view of the sheet metal blank from which the flexible pin type contact shown in FIG. 1 is formed.

The exemplary flexible pin type contact 10 shown in FIG. 1 is of one piece construction and is formed from a flat metal blank 22 as shown in FIG. 2. A suitable metal for this purpose is 4 mil thick beryllium copper. Conveniently, a number of blanks will be stamped out of a single sheet of metal so as to be held together at one end by a carrier strip (not shown) for efficient forming of the contacts. To enhance conductivity and resist corrosion, selected surface portions of each blank can be plated with gold to a thickness of 0.05 mil.

Figure 3:
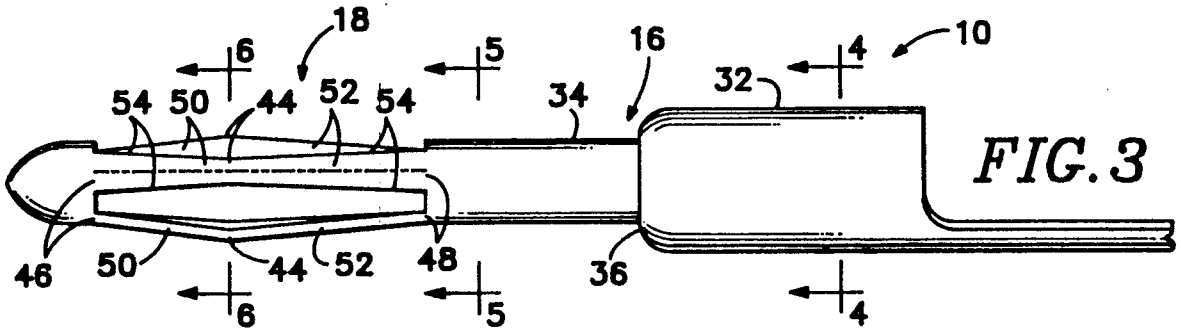
FIG. 3 is an elevational side view taken along line 3—3 of FIG. 1.
Figure 4:
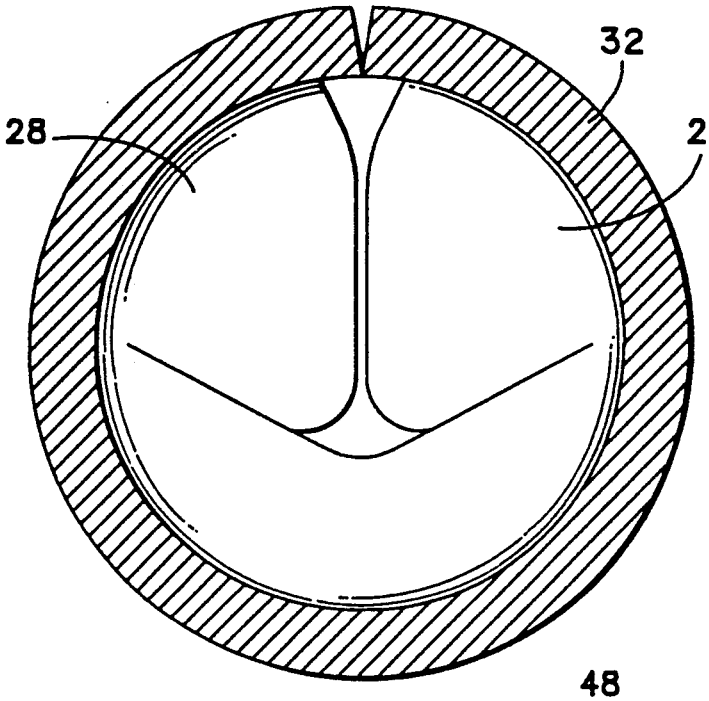
FIG. 4 is an enlarged sectional view taken along line 4—4 of FIG. 3.

Referring to FIG. 2, the blank 22 includes a laterally enlarged portion 24 and a laterally narrowed portion 26 that have representative widths, respectively, of 115 and 50 mils. The laterally enlarged portion 24 includes a pair of rounded forward flap regions 28 and a pair of slits 30 that longitudinally extend to the rearward end of the laterally narrowed portion 26. To form sleeve member 16, the laterally enlarged and narrowed portions 24 and 26 are rolled back toward center line 31 to create, respectively, as shown in sectional view in FIGS. 4 and 5, larger and smaller cylindrical split barrels 32 and 34. The forward flap regions 28 are rearwardly folded back as shown in FIG. 4 to close off the forward mouth of the larger cylindrical split barrel 32. Referring to FIG. 3, the smaller forward barrel 34 can be bent relative to the larger rearward barrel 32 to align the longitudinal axis of each barrel whereupon the larger barrel 32 provides a continuous rim 36 surrounding the smaller barrel 34. Upon engagement of contact 10 with a socket (not shown in FIG. 3) this continuous rim 36 permits the socket to be seated on the contact. The inner circumference of the socket should about match the outer circumference of the smaller barrel 34, a representative value for this outer circumference being about 20 mils in accordance with the representative dimensions given above.

Figure 5:
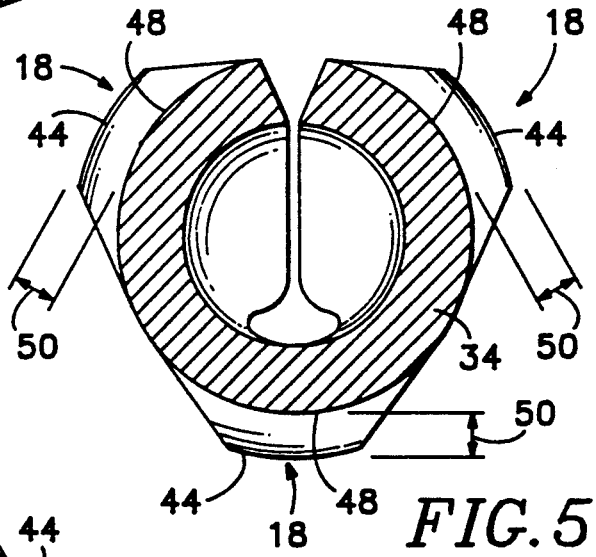
FIG. 5 is an enlarged sectional view taken along line 5—5 of FIG. 3.

Referring to FIG. 1, elongate arm members 18 give flexibility to the pin contact 10 so that engagement can be made with different sockets 14 that vary somewhat in inner diameter. More specifically, the exemplary pin contact 10 includes three elongate arm members 18 forwardly extending from sleeve member 16. Viewing FIGS. 3 and 5 together, after the forming of sleeve member 16 as described above, the elongate arm members 18 are integrally attached to the front end of the forward barrel 34 at circumferentially-spaced locations thereon. Referring to FIG. 2, each exemplary arm member 18 includes an intermediate narrowed section 44. This narrowed section is made to protrude radially outwardly beyond the outer circumference of the forward barrel 34 as the opposed ends 46 and 48 of each arm member are folded back toward each other as shown in FIGS. 3 and 5. Due to this folding back of the arms, as shown in FIG. 5, each arm 18 has a range of radial movement 50 over which the arm can flexibly shift to accommodate different sockets that may vary somewhat in diameter.

Figure 6:
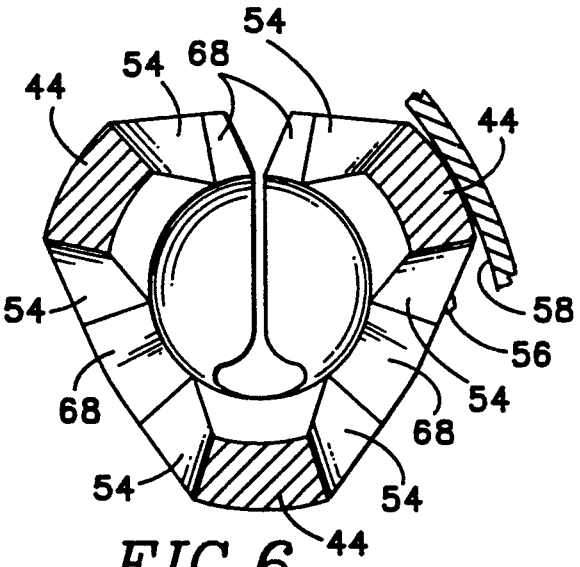
FIG. 6 is an enlarged sectional view taken along line 6—6 of FIG. 3.

Referring to FIG. 2, the intermediate narrowed section 44 of each arm member 18 is bordered by a forward and a rearward arm portion, 50 and 52 respectively, that laterally taper toward each other and connect together to form the intermediate narrowed section 44. Consistent with the representative dimensions given above, the forward and rearward arm portions can be made 10 mil across at their widest ends and 6 mil across where they combine together to form the intermediate narrowed section 44. As indicated in FIG. 3, each respective arm portion 50 and 52 includes a pair of opposed flared edge portions 54. As shown in FIG. 6, depicting a view in a plane transverse to the arms, these flared edge portions 54 are folded back toward each other along a semi-elliptical curve so that the radius of curvature of each arm portion 50 or 52 is made smaller than the radius of curvature of the inner surface of the mating socket. This keeps any burrs created along the corner edges of the arms during stamping away from the inner surface of the socket so that they cannot interfere with reliable electrical contact. This is represented in FIG. 6 where a burr, denoted as item 56, is kept away from the schematically depicted inner wall 58 of a mating socket. Additionally, the central crowned portion of each arm can bend slightly upon engagement to reduce somewhat the forces acting between the surfaces actually in contact.

It will be recognized, therefore, that forming of the elongate arms of the exemplary pin type contact 10 involves two separate bending operations. Referring to FIG. 3, one bending operation occurs as the opposed ends 46 and 48 of each arm are brought together to cause the intermediate narrowed section 44 of each arm to flexibly diverge outwardly from the narrowed sections on the other arms. A second bending operation occurs as the opposed flared edges 54 on each arm are folded back about an axis generally longitudinal to each arm. These two bending operations could not be advantageously performed together were it not for the intermediate notched section 44 included on each arm member 18. More specifically, the intermediate notched section 44 makes it possible to bend the flared edges 54 along a semi-elliptical curve (FIG. 6) while still providing a useful range of movement 50 for each arm (FIG. 5).

In the preferred embodiment of the electrical pin contact shown in FIG. 2, the intermediate narrowed section 44 is located forwardly of the longitudinal center of the corresponding elongate arm member 18. Alternatively stated, the length 60 of each respective rearward arm portion (i.e., 60 mil) is larger than the length 62 of the corresponding forward arm portion (i.e., 40 mil). This configuration ensures that pin contact 10 will securely engage the inner surface of socket even though a predominant portion of each arm member 18 remains outside the socket.

Viewing FIGS. 1 and 2 together, the preferred embodiment of the pin contact further includes a forwardly tapering one-piece nose member 20. The three elongate arm members 18 extend rearwardly from and are integrally attached to the back end of this nose member 20. After the blank is folded along centerline 31 and after appropriate bending of that portion of the blank which will become nose member 20, the elongate arm members are positioned at the back end of nose member 20 at circumferentially-spaced locations thereon, these circumferentially-spaced locations corresponding to the circumferentially-spaced locations at which the arms 18 attach to the front end of sleeve member 16.

For the preferred embodiment of the pin type contact 10 shown in FIGS. 1 and 2, the nose member 20 is formed from first and second wedge-shaped tip portions 64 and 66 respectively. Each tip portion includes a pair of forwardly tapering edges 68 that are folded back toward each other during formation of the nose member 20. The tip portion 64 and 66 are oppositely arranged to one another so that each respective edge of the first tip portion 64 is in back-to-back relation with a corresponding respective edge of the second tip portion 66 as indicated in FIG. 1. Referring again to FIG. 2, the attachment of the arm members 18 to the tip portions 64 and 66 is such that a first arm member is attached to the first tip portion 64 between the pair of edges 68 thereof, a second arm member is integrally attached to the second tip portion 66 between the pair of edges 68 thereof, and a third arm member is integrally attached to the first 64 and second 66 tip portions between a respective edge 68 of the first tip portion 64 and a corresponding respective edge 68 of the second tip portion 66. In this fashion, a one-piece forwardly tapering nose member 20 is formed from the same blank 22 used to form the remainder of the pin contact 10. Because of the forward taper on the nose member 20 and the existence of the three elongate arm members 18, if axial misalignment exists between the pin contact 10 and a socket, the axis of nose member 20 will reposition itself relative to the axis of sleeve member 16 to allow engagement of the pin contact 10 with the socket.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited on by the claims which follow.

What is claimed is:

1. An electrical pin type contact formed from a metal sheet for wiping engagement with the inner surface of a tubular metal socket, said pin type contact comprising:

(a) a sleeve member having a generally cylindrically formed front end;

(b) a plurality of elongate arm members extending forwardly from and integrally attached to said front end at circumferentially-spaced locations thereon, each respective arm member including forward and rearward elongate opposed arm portions each laterally tapering so as to narrow toward the other to form an intermediate narrowed arm section between said opposed arm portions, the corresponding arm portions of said elongate arm members diverging flexibly from each other as they approach said intermediate narrowed arm sections so that said narrowed arm sections can establish said wiping engagement;

(c) each respective forward and rearward arm portion including opposed elongate edges, said opposed edges of said arm member being folded inwardly toward each other so that said edges cannot wipingly engage the inner surface of said tubular metal socket.

2. The electrical pin type contact of claim 1 wherein each respective intermediate narrowed arm section is located forwardly of the longitudinal center of the corresponding elongate arm member.

3. The electrical pin type contact of claim 1 further comprising a forwardly tapering nose member having a generally cylindrically formed back end, said elongate arm members being at least three in number and extending rearwardly from and integrally attached to said back end at circumferentially-spaced locations thereon.

4. The electrical pin type contact of claim 3 wherein said nose member includes a first and second wedge-shaped tip portion, each tip portion including a pair of forwardly tapering edges folded inwardly toward each other, said tip portions being oppositely arranged so that each respective edge of said first tip portion is in side-by-side relation with a corresponding respective edge of said second tip portion; a first, second and third one of said elongate arm members being attached to said nose member, said first one of said elongate arm members being integrally attached to said first tip portion between said pair of edges thereof, said second one of said elongate arm members being integrally attached to said second tip portion between said pair of edges thereof, said third one of said elongate arm members being integrally attached between said first and second tip portions between a respective edge of said first tip portion and the corresponding respective edge of said second tip portion.

* * * * *